US006247943B1

(12) United States Patent
Moga et al.

(10) Patent No.: US 6,247,943 B1
(45) Date of Patent: Jun. 19, 2001

(54) ELECTRICAL CONNECTION FOR A SPARK PLUG AND METHOD OF ASSEMBLING THE SAME

(75) Inventors: Viorel Moga, Anderson; Mark Albert Paul, Fishers; Brian DeWayne Lively, Noblesville, all of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/387,337

(22) Filed: Aug. 31, 1999

(51) Int. Cl.[7] ..... H01R 13/44
(52) U.S. Cl. ..... 439/125
(58) Field of Search ..... 439/125, 92, 521, 439/607, 174, 152; 313/125, 206; 336/96, 92

(56) References Cited

U.S. PATENT DOCUMENTS 5,679,012 10/1997 Murata ..... 439/125
5,749,742 * 5/1998 Bertuzzi, Jr. et al. ..... 439/125
5,949,310 * 9/1999 Nuebel et al. ..... 336/96
5,980,284 * 9/1999 Ho et al. ..... 439/159

* cited by examiner

*Primary Examiner*—Gary F. Paumen
*Assistant Examiner*—Phuongchi Nguyen
(74) *Attorney, Agent, or Firm*—Margaret A. Dobrowitsky

(57) ABSTRACT

An electrical connection between a high voltage terminal and a spark plug head. A case contains a high voltage terminal connected to a high voltage source. A connector portion extends from a bottom portion of the case, which in turn is secured to an insulator boot for attachment to the spark plug. The high voltage terminal has a nipple extending within the connector portion. A barrel shaped coil spring is snapped over the nipple and positively retained thereto. The head of the spark plug is inserted within the connector portion and engages the barrel shaped coil spring. The barrel shape of the coil spring offers a smaller height with an increased working length thereby providing a larger tolerance between the high voltage terminal and the spark plug head.

14 Claims, 2 Drawing Sheets

ELECTRICAL CONNECTION FOR A SPARK PLUG AND METHOD OF ASSEMBLING THE SAME

TECHNICAL FIELD

The present invention relates to a connection between a high voltage terminal and a spark plug head and more particularly to a coiled spring disposed between the high voltage terminal and spark plug head and its method of assembly.

BACKGROUND OF THE INVENTION

Electrical connections between a high voltage terminal and a spark plug head are well known in the art. Typically, a high voltage lead wire extends from a central high voltage source coil assembly. The lead wire contains a high voltage metal sheath with an insulating coating. The metal conductor sheath is connected to a connector usually formed of stamped sheet metal which forms an encircling clamp that snaps onto the spark plug head. An insulating boot is also provided to cover the connection between the high voltage lead wire and the spark plug. This arrangement does not provide any tolerance when assembling the connection. The resilient insulator boot must be sufficiently disposed over the spark plug before the connection can be made with the spark plug head. Furthermore, these prior art arrangements often result in the disconnection between the clamp and metal sheath when the lead wire is disconnected from the spark plug. In this case, the lead wire must be replaced.

It is also known to employ a spring within an electrical connection of a spark plug head. However, prior art connections employing springs are complex, costly, often undesirably and inadvertently connect the spring directly to the spark plug head, and do not provide a positive securement of the spring to the high voltage terminal. Moreover, the prior art devices require complicated techniques and specialized tools to assemble.

SUMMARY OF THE INVENTION

To solve problems of the prior art such as the foregoing, the present invention provides a simplified design for an electrical connection between a spark plug head and a high voltage terminal facilitating easy assembly. A barrel shape coil spring is disposed within a connection portion of a case adjacent a high voltage terminal. A longitudinal rod is inserted into the connector portion and one end of the barrel shaped coil spring is forced over the nipple portion of the high voltage terminal in a snap fit fashion thereby positively securing the spring thereto. The connector portion of the case has a resilient insulator boot secured thereto and extends to and frictionally engages the ceramic insulator portion of the spark plug to maintain the connection. The case and insulator boot is forced onto the spark plug. The spark plug head engages an opposite end of the barrel shaped coil spring to form an electrical connection to the high voltage terminal. The insulator boot frictionally engages the ceramic insulator portion of the spark plug to maintain the connection. The barrel shape of the coil spring offers a smaller height with an increased working length thereby providing a larger tolerance between the high voltage terminal and the spark plug head. Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENT

The preferred embodiments of the present invention are hereinafter described with reference to the accompanying drawings.

Figure 1:
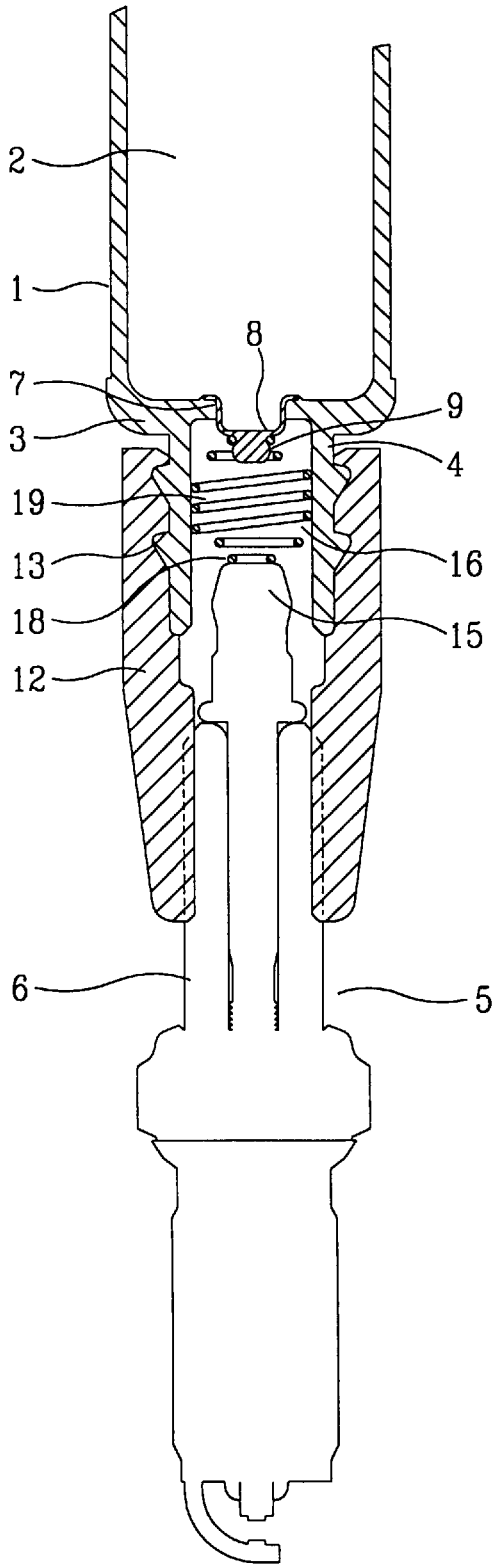
FIG. 1 is a sectional view of the spark plug connection according to the present invention.

FIG. 1 depicts the electrical connection according to the present invention. A case member 1 has a central housing 2 adapted to contain a pencil coil arrangement as may be known in the art. However, the central housing 2 may house a terminal lead wire extending from a centrally located coil. The case 1 extends to bottom portion 3, from which a connector portion 4 extends towards the ceramic insulator portion 6 of the spark plug 5. The connector portion 4 is preferably a hollow tube extending from the bottom portion 3 of the case member 1 and having outwardly extending barbs 13. A high voltage terminal 8 extends through a bore 7 extending through the bottom portion 3 of the case 1. A nipple 9 having a wide portion 10 and a narrow portion 11 extends within the connector portion 4. An insulating boot 12 made of a resilient material is secured to the connector portion 4 via barbs 13 extending outwardly from the connection portion 4. The insulator boot 12 extends about and frictional engages the ceramic insulator 6 to maintain the connection.

The spark plug head 15 is disposed within the insulator boot 12 and connector portion 4 of the case 1. A barrel shaped coil spring 16 is disposed between the spark plug head 15 and the nipple 9. One first end 17 of the barrel shaped coil 16 spring has an inner diameter slightly smaller than the wide portion 10 of nipple 9 and slightly larger than the narrow portion 11. The first end 17 of the barrel shaped coil spring 16 is snapped over the nipple 9 and positively retained thereto. Such an arrangement prevents the coil spring from accidentally being dislodged from the high voltage terminal when the spark plug head 15 is removed.

Figure 3:
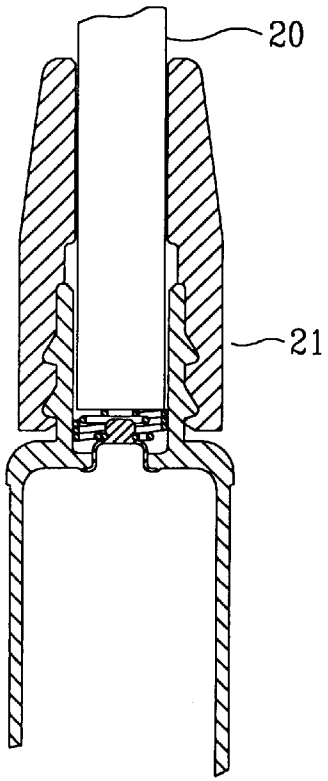
FIG. 3 is a sectional view of the spark plug connection of FIG. 2., during assembly.

The barrel shape of the coil spring 16 allows successive turns to collapse within itself. In other words, when the barrel shaped coil spring 16 is fully or nearly collapsed as depicted in FIG. 3, the length of the collapsed coil spring 16 is less than the sum of the number of turns of the coil spring 16 multiplied by the width of the spring wire. Note Figure 3, where the ends 17, 18 of the coil spring 16 are at least partially disposed within a central portion 19 of the spring. Such a spring shape allows the spring to collapse further than a conventional cylindrically shaped coil spring.

A second opposite end 18 of the barrel shaped coil spring 16 is disposed adjacent to the spark plug head 15 and has a diameter smaller than the flat end surface of the spark plug head 15 to prevent inadvertent attachment of the coil spring to the spark plug. Preferably the barrel shaped coil spring 16 is symmetrical. Each of the ends 17 and 18 has the same diameter and shape. Such an arrangement facilitates easy assembly of the connection.

Figure 2:
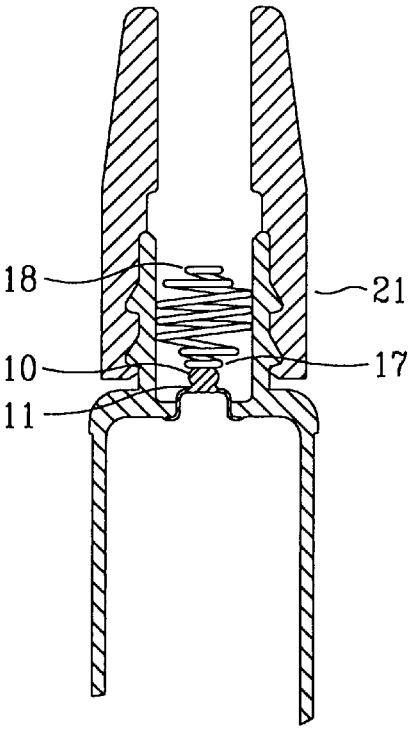
FIG. 2 is a sectional view of the spark plug connection of FIG. 1 in a pre-assembled state.
Figure 4:
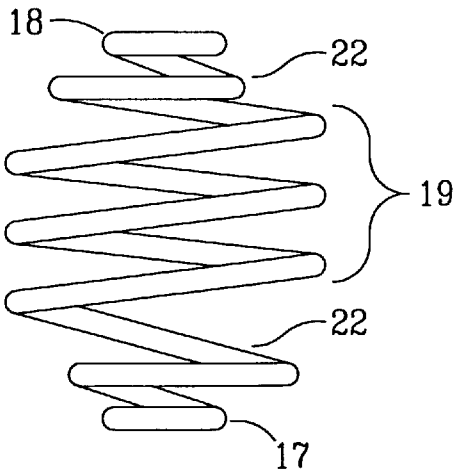
FIG. 4 is an enlarged side view of the barrel shaped coil spring employed in FIGS. 1–3.

FIGS. 2 and 3 depict an electrical assembly 21 of the present invention in different stages of assembly. FIG. 2 depicts the high voltage terminal 8 already disposed within bore 7 and secured to the bottom portion of the case such that the nipple 9 extends within the connector portion 14. The insulator boot 12 already being secured to the connector portion 4, and coil spring 16 already simply dropped/inserted into the connector portion 4. The coil spring 16 has a maximum diameter less than an inner diameter of the connector portion 4 and a length sufficient to prevent the coil spring 16 from turning once dropped within the connector portion 4. Such an arrangement allows the coil spring 16 to be simply dropped into the connector portion 4 without any specific orientation and will self align adjacent the wide portion 10 of the nipple 9 upon insertion.

FIG. 3 depicts the assembly of the coil spring to the high voltage terminal 8. A longitudinal rod 20 is inserted into the insulator boot 12 and connector portion 4 to engage the coil spring 16. The longitudinal rod 20 is further inserted to compress the coil spring 16 and force the first end 17 of the coil spring 16 to snap over the wide portion 10 of the nipple 9 to engage the narrow portion 11 thereof and be positively retained thereto.

The longitudinal rod 20 is then removed and the connection assembly is simply inserted onto the spark plug. Specifically, the connection assembly 21 is inserted on the spark plug 5 such that the spark plug head 15 partially compresses the coils spring 16 and the insulating boot 12 engages the ceramic insulator 6 of the spark plug 5 to maintain the overall connection.

The barrel shaped coil spring is preferably made of a stainless steel type 301/302-spring wire having a diameter of $0.635_{mm}$ $+/-0.0127_{mm}$. The overall length of the barrel shaped coil spring is preferably between 10.5 and $12.0_{mm}$ having between 8.5 to 9.5 turns. The central portion has at least three turns, a length of about $3.5_{mm}$ and a maximum diameter of between 8.82 and $9.32_{mm}$. Each end of the barrel shaped coil has a substantially enclosed turn having an internal diameter between 2.21 to $2.34_{mm}$ to facilitate the snap fit about nipple 9. Transition turns 22 of at least 1.5 turns having progressively increasing diameter extend between each end and the central portion. The barrel shaped coil spring 16 is symmetrical to eliminate the need for any specific alignment during the assembly process. The barrel shape of the coil spring 16 simultaneously offers smaller height with an increased working length thereby allowing a higher tolerance between the high voltage terminal and the spark plug head.

The case member 1 is preferably a hollow member defining the central housing to house a pencil coil assembly. The pencil coil assembly including both a primary and secondary windings about a core to produce a high voltage signal to excite the spark plug 5. The high voltage terminal 8 being attached to the high voltage tower of the coil assembly that is in turn connected to the high voltage signal produced from the secondary winding. With this arrangement, each case member 1 contains a coil assembly to produce the high voltage signal for the spark plug to which it is attached. The connection assembly thereby providing an easy connection of the coil assembly to the spark plug. However, the connection assembly, while preferably embodied in a direct ignition system, may also be employed in conventional ignition systems employing a central coil. In such an arrangement, the case member 1 forms a connection with a conventional lead wide stemming from the distributor. The high voltage terminal 8 being connected to the inner metal sheath or wire containing the high voltage signal generated from the conventional coil/distributor system.

The present invention provides an electrical connection between a high voltage source (preferably a high voltage terminal of a pencil coil assembly) and the head 15 of a spark plug 5. The ease of assembly and relatively simple design provide an improved connection than the prior art.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A combination spark plug and electrical connection assembly;

said assembly comprising:

a case having a central housing extending to s bottom portion and connector portion further extending therefore, a bore extending through said bottom portion to expose an internal portion of said connector portion to said housing; said connector portion having a plurality of externally extending barbs;

a high voltage unitary cup member disposed within said bore and secured to said bottom portion of said case, said high voltage unitary cup member having a nipple extending within said connector portion, said nipple having a wide portion and a narrow portion disposed between said wide portion and said bottom portion of said case, a hollow resilient insulator engaging said barbs and thereby secured to said connector portion of said case and further extending therefrom;

a substantially symmetrical barrel shaped spring having opposite ends of substantially equal diameter an inner dimension of which is smaller than said wide portion and larger than said narrow portion of said nipple, one end being disposed about said narrow portion of said nipple thereby providing a positive connection there between, said barrel shaped coil spring having transition turn extending from each of said opposite ends to a central portion having a diameter larger than said opposite ends such that upon compression of said barrel shaped coil spring, at least one of said opposite ends and at least one of said transition turns are disposed within said central portion;

said spark plug comprising:

a spark plug head disposed within said insulator boot and said connector portion of said case and engaging said barrel shaped coil spring thereby providing an electrical connection to said high voltage unitary cup member; and a ceramic insulator disposed within and frictional engaging said insulator boot to thereby maintain a connection between said spark plug and said connection assembly.

2. An electrical connection between a high voltage source and a spark plug, said spark plug having a head terminal and a ceramic insulating portion, said connection comprising:

a case having a central housing extending to a bottom portion, said case having a connector portion extending from said bottom portion and being disposed about said spark plug head and extending towards said ceramic insulator portion;

an insulator boot secured to said connector portion of said case and frictionally engaging said ceramic insulator portion of said spark plug to connect said case to said spark plug;

a high voltage terminal secured to said bottom portion of said case and having a nipple portion extending within said connector portion; and a symmetrical barrel shaped coil spring formed of a number of turns of a spring wire, said symmetrical barrel shaped coil spring having a first end disposed about said nipple portion and a second end contacting an end surface of said spark plug head forming a high voltage electrical connection there between, said first and second ends each having a substantially equal first diameter and having transition turns extending therefrom towards a central portion having a second diameter larger than said first diameter, wherein said second diameter is sufficiently large such that upon compression of said symmetrical barrel shaped coil spring by said spark plug one of said first and second ends together with said transition turns are disposed within said central portion such that an overall length of the collapsed spring is less than a sum of a number of turns of said spring multiplied by a width of the spring wire.

3. The electrical connection according to claim 2, said connector portion of said case has a plurality of externally extending barbs disposed within said insulator boot and engaging an inner surface thereof thereby forming a secure attachment thereto.

4. The electrical connection according to claim 2, wherein said spring wire is formed of stainless steel and said width of said spring wire is about 0.635 $_{mm}$.

5. An electrical connection between a high voltage source and a spark plug, said spark plug having a head terminal and a ceramic insulating portion, said connection comprising:

a case having a central housing extending to a bottom portion, said case having a connector portion extending from said bottom portion and being disposed about said spark plug head and extending towards said ceramic insulator portion;

an insulator boot secured to said connector portion of said case and frictionally engaging said ceramic insulator portion of said spark plug to connect said case to said spark plug;

a high voltage terminal secured to said bottom portion of said case and having a nipple portion extending within said connector portion; and a symmetrical barrel shaped coil spring having a first end disposed about said nipple portion and a second end contacting an end surface of said spark plug head forming a high voltage electrical connection there between, said first and second ends each having a substantially equal first diameter and having transition turns extending therefrom towards a central portion having a second diameter larger than said first diameter, wherein said second diameter is sufficiently large such that upon compression of said symmetrical barrel shaped coil spring one of said first and second ends together with said transition turns are disposed within said central portion, wherein said high voltage terminal and nipple portion are integrally formed as a unitary cup member, said case having a bore extending through said bottom portion exposing said central housing to said connector portion, said unitary cup member being disposed within said bore and secured to said case, said nipple portion having a wide portion adjacent a terminal end and a narrow portion disposed between said wide portion and said bottom portion of said case, said first end of said symmetrically barrel shaped coil spring having an inner diameter slightly smaller than said wide portion and larger than said narrow portion of said nipple portion, and said first end of said coil spring being disposed around said narrow portion such that said wide portion prevents said coil spring from dislodging from said nipple portion of said high voltage terminal.

6. The electrical connection claim 5, wherein said transition turns are substantially identical and extend toward a corresponding one of said first and second ends in a symmetrical fashion relative to said central portion.

7. The electrical connection according to claim 6, wherein said central portion has at least three turns and each of said transition turns has at least 1.5 turns.

8. The electrical connection according to claim 7, wherein said each of said opposite ends has a substantially closed turn having an internal diameter between 2.21 $_{mm}$ to 2.34 $_{mm}$.

9. An electrical connection for a spark plug comprising:

a case having high voltage terminal adapted to be connected to a high voltage source for exciting said spark plug;

an insulating boot secured to said case and adapted to be connected to said spark plug; and a barrel shaped coil spring secured to said high voltage terminal and adapted to bear against a head of said spark plug thereby establishing an electrical connection there between, wherein said barrel shaped coil spring comprises a substantially symmetrical coil extending between extreme opposite ends, said opposite ends each having a substantially equal first diameter and having transition turns extending therefrom towards a central portion having a second diameter larger than said first diameter, wherein said second diameter is sufficiently large such that upon compression of said barrel shaped coil spring said opposite ends and said transition turns may be disposed within said central portion.

10. The electrical connection according to claim 1, wherein said high voltage terminal has a nipple portion having a wide portion adjacent a terminal end and a narrow portion disposed between said wide portion and said case, and one end of said barrel spring is disposed about said narrow portion of said nipple portion in a snap fit fashion thereby establishing a positive connection there between.

11. The electrical connection according to claim 2, wherein an opposite end of said barrel spring contacts said spark plug head and has a diameter smaller than a diameter of said spark plug head to prevent said coil spring from attaching to said spark plug.

12. The electrical connection for a spark plug according to claim 1, wherein said transition turns are substantially identical and extend toward a corresponding one of said opposite ends in a symmetrical fashion relative to said central portion.

13. The electrical connection for a spark plug according to claim 12, wherein said central portion has at least three turns and each of said transition turns has at least 1.5 turns.

14. The electrical connection for a spark plug according to claim 13, wherein said each of said opposite ends has a substantially closed turn having an internal diameter between 2.21 $_{mm}$ to 2.34 $_{mm}$.

* * * * *